US006902494B1

(12) United States Patent
Frishberg

(10) Patent No.: US 6,902,494 B1
(45) Date of Patent: Jun. 7, 2005

(54) GOLF PRACTICE DEVICE

(76) Inventor: Dov Frishberg, 600 W. 115th St., New York, NY (US) 10025

( * ) Notice: Subject to any disclaimer, the term of this patent is extended or adjusted under 35 U.S.C. 154(b) by 0 days.

(21) Appl. No.: 10/779,094

(22) Filed: Feb. 13, 2004

(51) Int. Cl.[7] ..... A63B 69/36
(52) U.S. Cl. ..... 473/278; 473/150
(58) Field of Search ..... 473/150, 157, 473/160, 162, 168, 278, 279; 52/5, 160, 403.1

(56) References Cited

U.S. PATENT DOCUMENTS

| | | | | |
|---|---|---|---|---|
| 1,594,359 | A | 8/1926 | Estabrook | |
| 3,143,096 | A | 8/1964 | Lester | |
| 3,423,096 | A | 1/1969 | Tone | |
| 3,622,161 | A | 11/1971 | Keppen | |
| 3,712,628 | A | 1/1973 | Boss, Jr. | |
| 3,869,128 | A | 3/1975 | Ohashi | |
| 4,928,966 | A | 5/1990 | Miller | |
| 4,932,663 | A * | 6/1990 | Makar | 473/262 |
| 4,955,611 | A | 9/1990 | Moller | |
| 5,356,147 | A | 10/1994 | MacDonald | |
| 5,593,355 | A | 1/1997 | Beaver | |
| 5,662,531 | A | 9/1997 | Durso | |
| 5,692,967 | A | 12/1997 | Guyer | |
| 6,312,345 | B1 | 11/2001 | Pelz | |
| 6,450,895 | B1 | 9/2002 | Galluzzo, Jr. | |

* cited by examiner

*Primary Examiner*—Stephen Blau
*Assistant Examiner*—Nini F. Legesse
(74) *Attorney, Agent, or Firm*—McCarter & English, LLP

(57) ABSTRACT

A practice device for use by golfers to practice golf swings includes a body having an opening. A ball-supporting surface is formed generally over the opening for supporting a golf ball thereon. The practice device also includes a supporting device spanning the opening for supporting the ball-supporting surface. The supporting device includes a plurality of plate members extending from the body into the opening and at least partially overlapping with each other such that at least a portion of the ball-supporting surface is deflectable in a generally downward direction so as to yield to a club head when the ball-supporting surface is struck by same. In this manner, the ball-supporting surface is adapted to absorb the impact created by the club head, while simulating the sensation of striking through a natural turf.

20 Claims, 7 Drawing Sheets

GOLF PRACTICE DEVICE

FIELD OF THE INVENTION

The present invention relates to a golf practice device and, more particularly, to a golf swing practice platform having a ball-supporting surface adapted to move in a downward direction when it is impacted by a golf club.

BACKGROUND OF THE INVENTION

In the past, various practice platforms and mats have been developed for use by golfers in practicing golf swings. Typically, these devices are provided with ball-striking surfaces adapted to support golf balls thereon such that the balls can be hit by golfers (see, e.g., U.S. Pat. Nos. 1,594,359, 3,143,350, 3,423,096, 3,622,161, 3,712,628, 3,869,128, 4,928,966, 4,955,611, 5,356,147, 5,593,355, 5,662,531, 5,692,967, 6,312,345 and 6,450,895). At least some of these devices are equipped with mechanisms which allow the ball-striking surfaces to deflect or move downwardly in response to a club head impacting same. These mechanisms are provided for absorbing impact created by a club head, simulating a natural turf (i.e., simulating a feeling experienced by a golfer in making a proper swing down through the ball and taking a divot), etc. For example, U.S. Pat. No. 1,594,359 discloses a practice board having a plurality of ball-supporting slates which are movable downwardly when impacted by a club head, while U.S. Pat. No. 3,423,096 discloses a golf practice mat equipped with a ball supporting member which is supported on a plurality of independent leaf springs for allowing the supporting member to move downwardly. Similarly, the driving mat disclosed in U.S. Pat. No. 3,869,128 includes a cantilevered lip for supporting a golf ball thereon such that the lip can deflect downwardly to minimize damage to the mat and the club, as well as discomfort experienced by the golfer. Likewise, the golf practice mat described in U.S. Pat. No. 5,692,967 is equipped with a mat tray having a set of casters such that the mat tray is movable downwardly along associated ramps in response to a club head impacting same.

While the foregoing practice devices are intended to yield to an impacting golf club, they have various shortcomings and disadvantages. For instance, the mechanisms utilized in these devices are fairly complicated and/or are not believed to perform such a function in an efficient or effective manner. In addition, after repeated use, the devices tend to wear out and need to be replaced. In the foregoing circumstances, there is a need for an improved golf practice device adapted to yield to a golf club.

SUMMARY OF THE INVENTION

The present invention overcomes the disadvantages and shortcomings of the prior art discussed above by providing an improved golf practice device allowing users to practice golf swings. More particularly, the practice device includes a body having an opening. A ball-supporting surface is formed generally over the opening for supporting a golf ball thereon. The practice device also includes a supporting device spanning the opening for supporting the ball-supporting surface. The supporting device includes a plurality of plate members extending from the body into the opening and at least partially overlapping with each other such that at least a portion of the ball-supporting surface is movable (e.g., deflectable) in a generally downward direction so as to yield to a club head when the ball-supporting surface is struck by same. In this manner, the ball-supporting surface is adapted to absorb impact created by the club head, while simulating the sensation of striking through a natural turf.

In accordance with one feature of the present invention, the plate members include first, second and third plate members which are cantilevered from the body such that they are deflectable in the downward direction when the ball-supporting surface is struck by the club head. The second plate member is interleaved between the first and third plate members.

BRIEF DESCRIPTION OF THE DRAWINGS

For a more complete understanding of the present invention, reference is made to the following detailed description of an exemplary embodiment considered in conjunction with the accompanying drawings, in which.

DETAILED DESCRIPTION OF THE INVENTION

Figure 1:
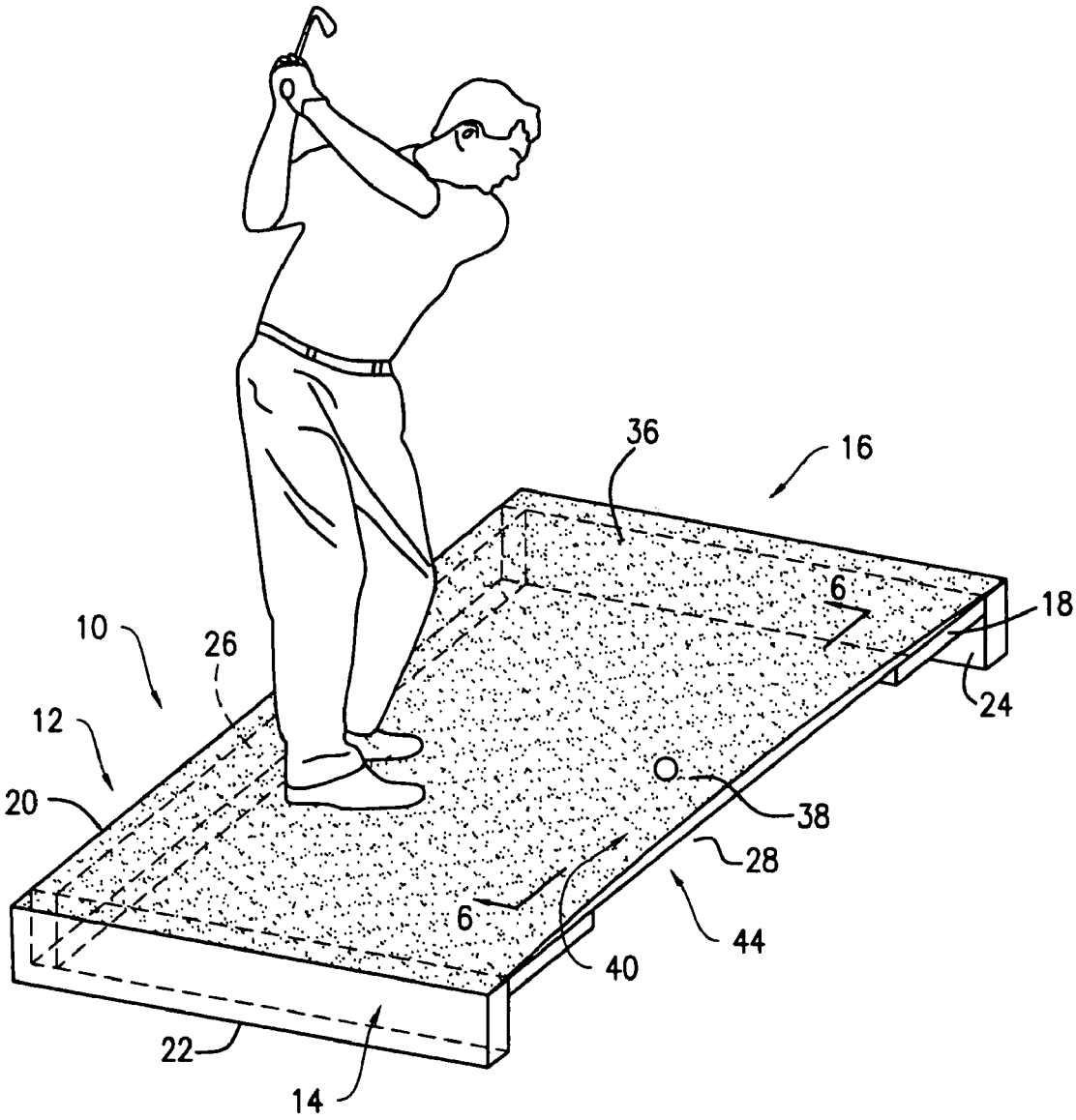
FIG. 1 is a perspective view of a golf practice platform constructed in accordance with the present invention.
Figure 2:
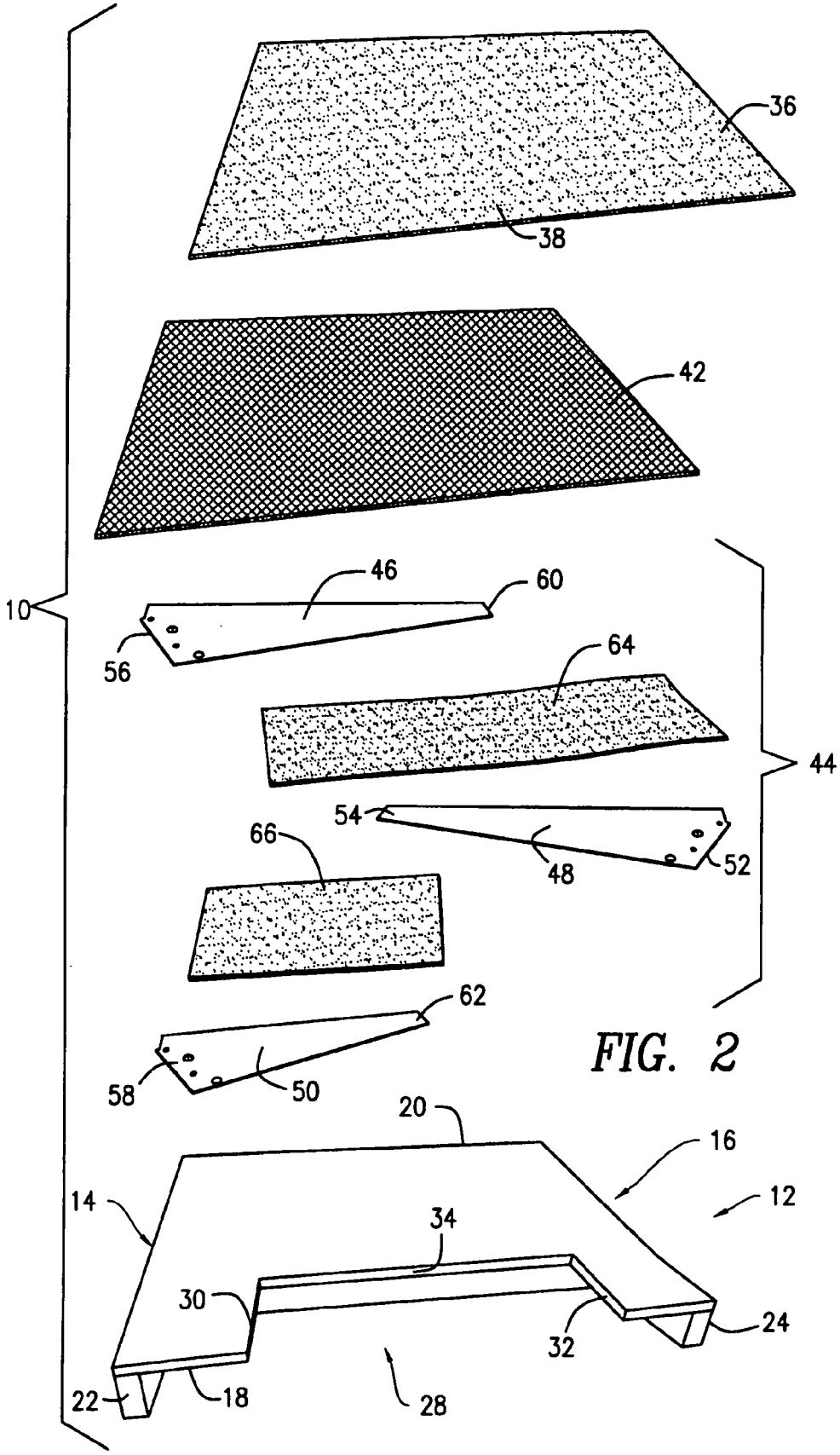
FIG. 2 is an exploded perspective view of the practice platform shown in FIG. 1.

With reference to FIGS. 1 and 2, there is shown a golf practice platform 10 constructed in accordance with the present invention. More particularly, the practice platform 10 includes a substantially planar stand or surface 12 having a pair of lateral sides 14, 16 and a pair of transverse sides 18, 20. The practice platform 10 also includes a pair of lateral support panels 22, 24 and a transverse support panel 26 (see FIG. 1) attached to the stand 12 for supporting the stand 12 in an elevated manner. As a result, the stand 12, which is adapted to support a person thereon, is suspended above a support surface (e.g., the ground) on which the practice platform 10 is placed.

Referring primarily to FIG. 2, a cutout or opening 28 is formed in the transverse side 18 of the stand 12. More particularly, the stand 12 has a pair of lateral edges 30, 32 and a transverse edge 34 defining the cutout 28. The lateral edges 30, 32 are spaced from each other in a lateral direction (i.e., in a direction substantially parallel to a longitudinal axis of the stand 12), while the transverse edge 34 is oriented substantially parallel to the longitudinal axis of the stand 12.

Figure 5:
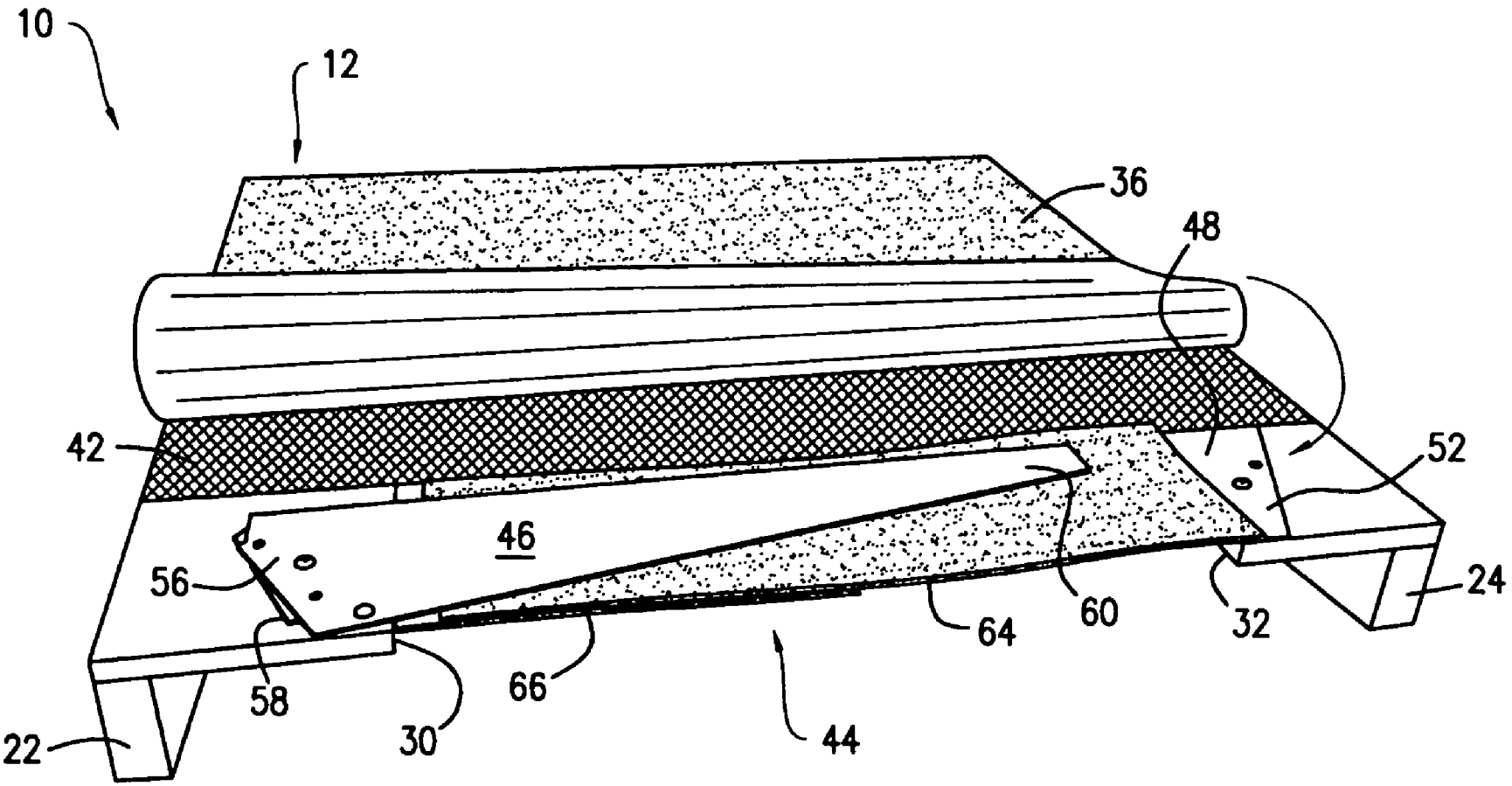

With reference to FIGS. 1, 2 and 5, the platform 10 is also provided with an upper or top cover layer 36 which is affixed to the stand 12 and which covers substantially the entire area of the stand 12, including the cutout 28. The upper layer 36 is preferably made from a material which forms an upper layer of a conventional golf practice mat (e.g., a synthetic material simulating a natural grass surface). The upper layer 36 has a portion 38 (see FIGS. 1 and 6) covering the cutout 28 and defining a ball-striking area (i.e., a ball-supporting surface) 40 of the platform 10. At least the portion 38 of the upper layer 36 is thin and substantially flexible. The platform 10 also includes a lower layer 42 (see FIGS. 2 and 3) positioned between the upper layer 36 and the stand 12. The lower layer 42 is made from a conventional anti-slip material so as to inhibit the upper layer 36 from moving relative to the stand 12, thereby allowing a person to stand on the platform 10 and practice golf swings. The lower layer 42 is also adapted to enhance the cushioning effect of the upper layer 36, increasing user-comfort, as well as the user's traction to the upper layer 36. The lower layer 42 is sized and shaped such that it does not cover the cutout 28 (see FIG. 3).

Now referring to FIGS. 2–5, the platform 10 includes a flexible surface-supporting device 44 spanning the cutout 28 for supporting the ball-striking area 40 of the platform 10 such that the ball-striking area 40 is movable or deflectable in a generally downward direction when it is struck by a club head. More particularly, the supporting device 44 has a plurality of overlapping or interleaving elongated plate members (i.e., blades) 46, 48, 50. More particularly, the plate member 48, which has a mounting end 52 attached to the lateral edge 32, extends from same into the cutout 28 toward the lateral edge 30 and terminates at a free end 54 which is spaced from the lateral edge 30. Because the plate member 48 is cantilevered from the lateral edge 32, it is adapted to deflect downwardly in response to a downward force applied thereto. Like the plate member 48, the plate members 46, 50 have mounting ends 56, 58, respectively, each of which is attached to the lateral edge 30. The plate members 46, 50 extend from the lateral edge 30 toward the lateral edge 32 and terminate at free ends 60, 62, respectively, each of which is spaced from the lateral edge 32. Because the plate members 46, 50 are cantilevered from the lateral edge 30, they are adapted to deflect downwardly in response to a downward force applied thereto. Each of the plate members 46, 48 has a sufficient length such that their free ends 60, 54, respectively, are located adjacent the lateral edges 30, 32, respectively (see FIG. 6). Unlike the plate members 46, 48, the plate member 50 has a shorter length such that its free end 62 is positioned proximate the midpoint of the cutout 28 (see FIGS. 3 and 6).

Still referring to FIGS. 2–5, the plate members 46, 48, 50 are arranged such that they are at least partially overlapped with each other. More particularly, the plate member 48 is interleaved between the plate members 46, 50 such that the free end 60 of the plate member 46 is movably supported on the plate member 48 and the free end 54 of the plate member 48 is movably supported on the plate member 50 (see also FIG. 6). Each of the plate members 46, 48, 50 is made from a flexible, resilient material (e.g., stainless steel, aluminum, plastic, etc.) such that they can bend downwardly in response to a downward force applied thereto and then return to their horizontal orientation. Due to their overlapping construction, the plate members 46, 48, 50 cooperate with one another to allow the supporting device 44 and hence the ball-striking area 40 to deflect in the downward direction when the ball-striking area 40 is struck by a descending club head.

Figure 3:
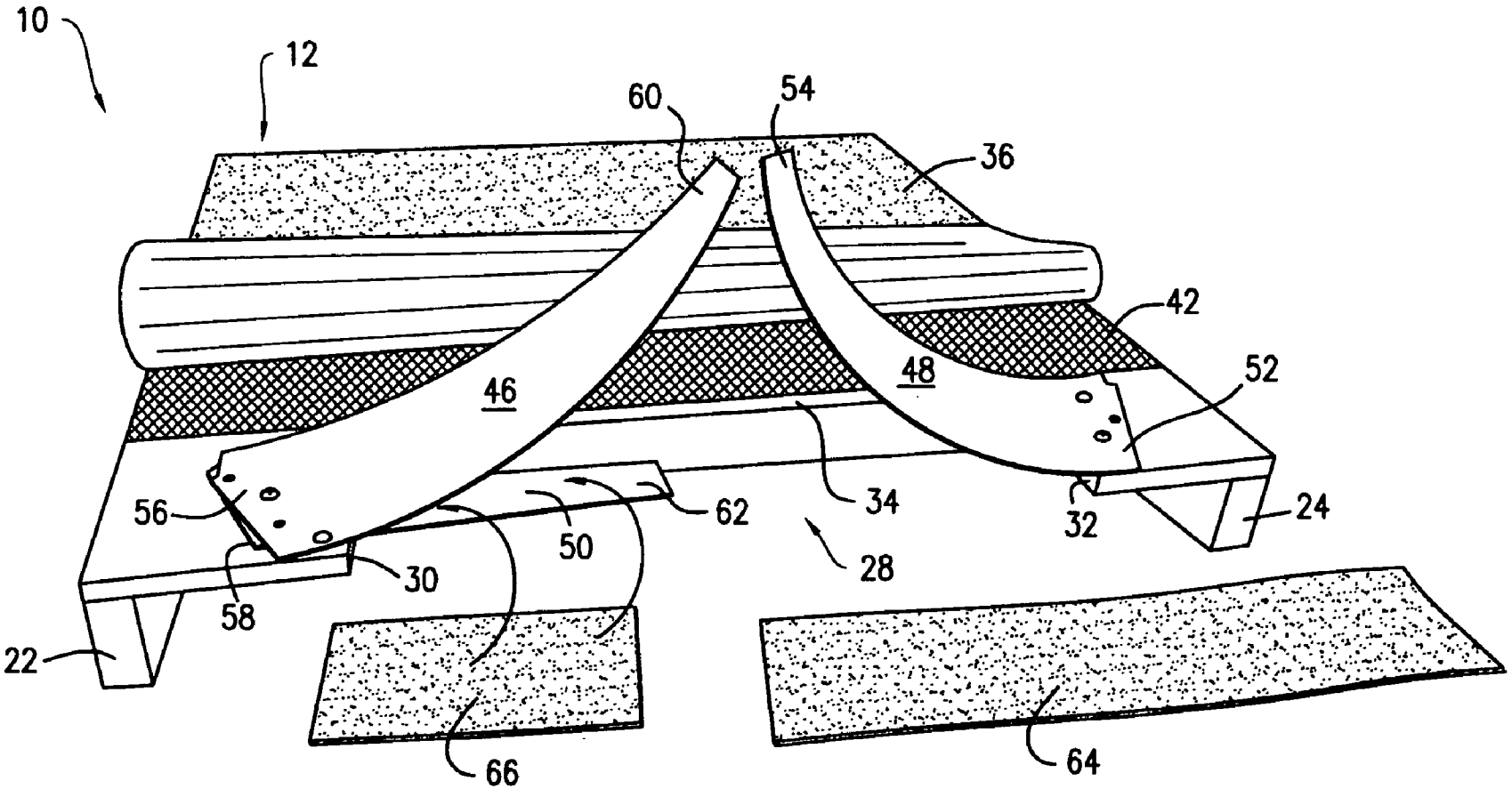
FIGS. 3–5 are schematic views of the practice platform shown in FIG. 1, illustrating the assembly of various parts of the practice platform.
Figure 4:
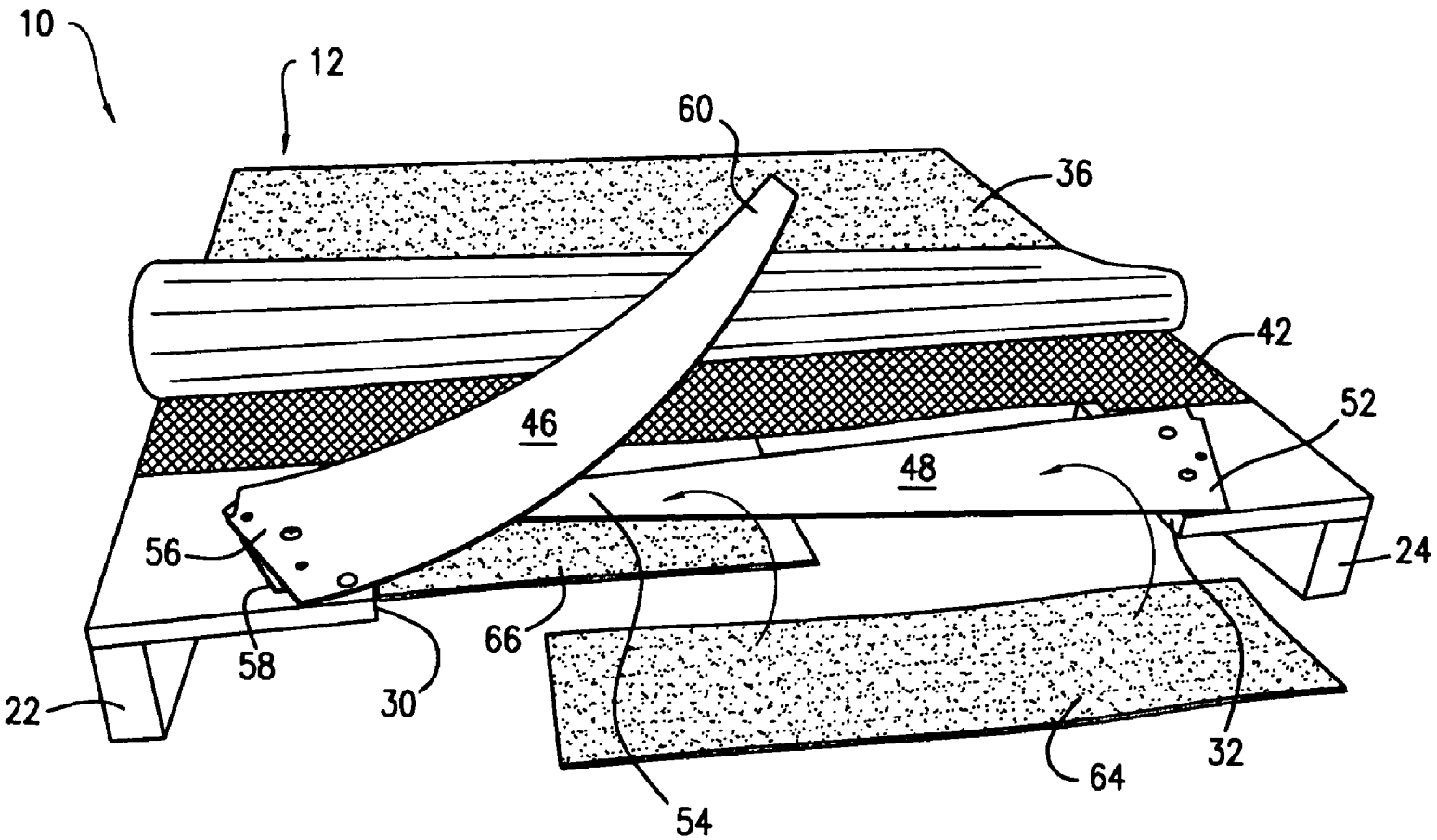

The supporting device 44 is also provided with a pair of strips 64, 66 made from a conventional material (see FIGS. 2–6), such as a weighty outdoor rug or mat. The strips 64, 66 are loosely positioned between the plate members 46, 48 (see FIGS. 4–6) and between the plate members 48, 50 (see FIGS. 3, 4 and 6), respectively, for purposes to be discussed hereinafter. Each of the strips 64, 66 can be inserted between a corresponding pair of the plate members 46, 48, 50 after the plate members 46, 48, 50 have been attached to the stand 12. More particularly, as illustrated in FIGS. 3–5, the strips 64, 66 can be sequentially inserted into the supporting device 44 by lifting the plate member 46, 48 upwardly. Alternatively, the strips 64, 66 can be assembled with the plate members 46, 48, 50 while the plate members 46, 48, 50 are attached to the stand 12. The strips 64, 66 can also be secured to the stand 12 by fasteners (e.g., the fasteners securing the plate members 46, 48, 50 to the stand 12).

Figure 6:
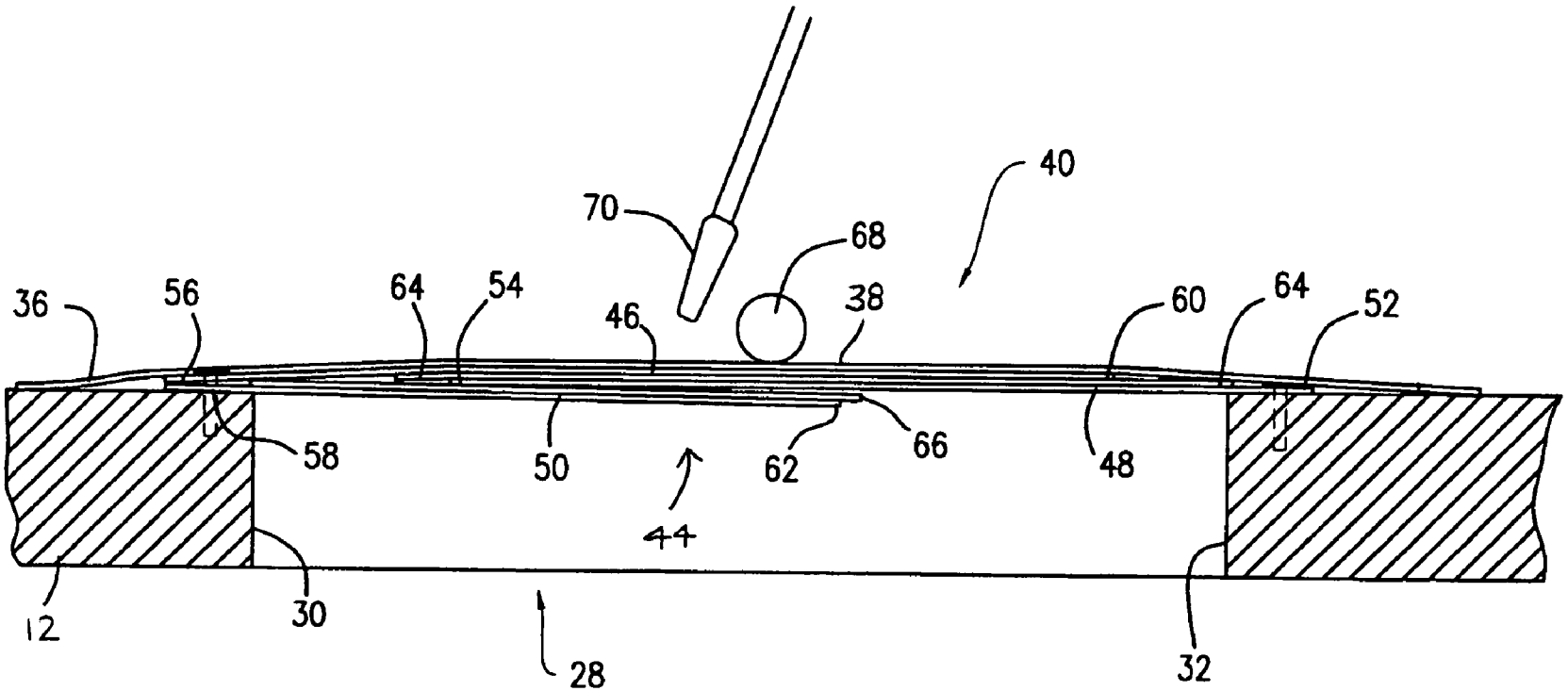
FIG. 6 is a cross-sectional view of a ball-supporting area of the practice platform shown in FIG. 1 prior to impact by a golf club head.
Figure 7:
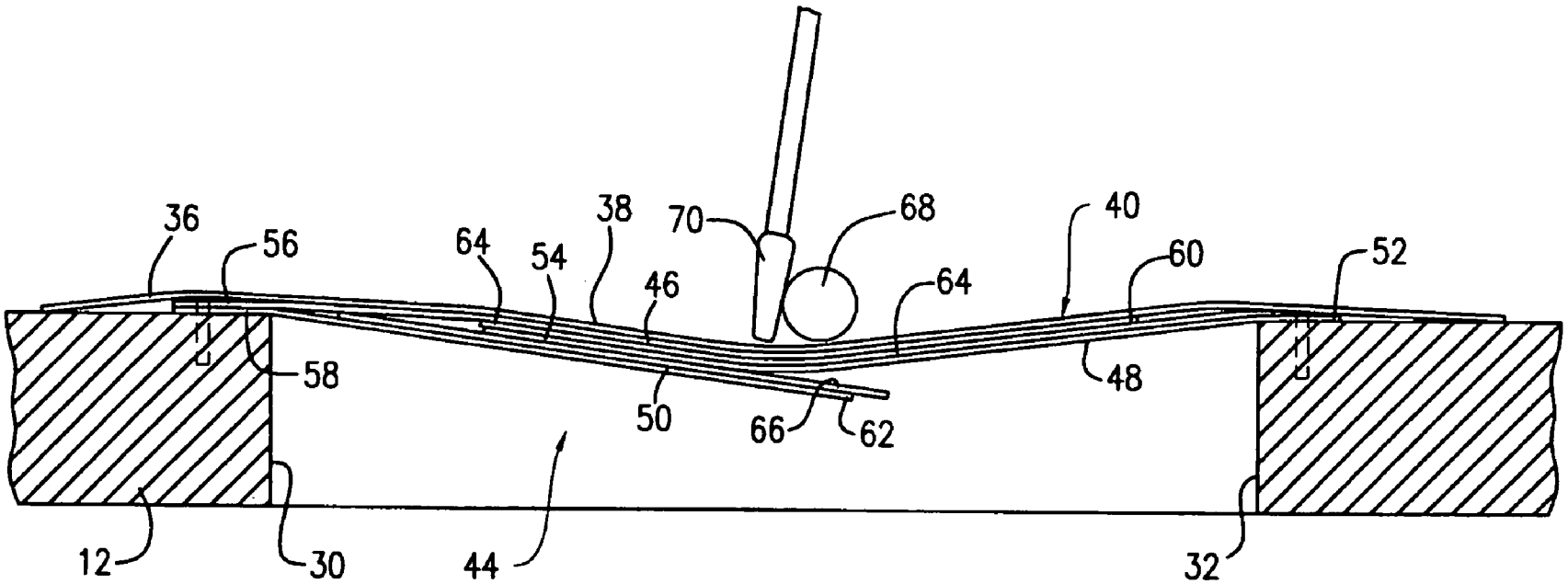
FIG. 7 is a cross-sectional view of the ball-supporting area of the practice platform shown in FIG. 1 during impact by a golf club head.

With reference to FIG. 6, each of the plate members 46, 48, 50 normally assumes a substantially horizontal shape, thereby positioning the supporting device 44 in a substantially planar orientation. As a result, the ball-striking area 40 is substantially planar and is thereby adapted to support a golf ball 68 thereon (see FIG. 6). When the ball-striking area 40 is struck by a head 70 of a golf club which is swung by a user standing on the platform 10, the plate members 46, 48, 50 deflect (or move) in the downward direction (see FIG. 7), allowing the ball-striking area 40 to bend downwardly and thereby permitting the club head 70 to pass "through" the ball 68 without encountering a significant drag. After the club head 70 passes through the ball-striking area 40, the plate members 46, 48, 50 return to their normal, substantially horizontal orientations.

Still referring to FIG. 6, the strips 64, 66 are adapted to reduce friction between the plate members 46, 48, 50, allowing free movement of the plate member 46, 48, 50 relative to one another upon impact by the club head 70. The strips 64, 66 also function to inhibit the plate members 46, 48, 50 from becoming entangled with one another when the plate members 46, 48, 50 shift downwardly and apart from each other upon impact by the club head 70 and then return to their normal, horizontal orientations.

It should be appreciated that the present invention provides numerous advantages over the prior art discussed above. For instance, because the ball-striking area 40 is adapted to yield to a club head, it absorbs impact created thereby, while simulating the sensation of striking through a natural turf. Moreover, because of their overlapping construction, the plate members 46, 48, 50 provide enhanced stability and resilience, and hence improved durability, to the supporting device 44. More particularly, the plate member 46, which directly supports the ball-striking area 40, is supported by the plate member 48, which, in turn, is supported by the plate member 50. As a result, the ball-striking area 44 is supported by an interleaving set of supporting members (i.e., the plate members 46, 48, 50), rather than by a single supporting member. In this regard, the strips 64, 66 cooperate with the plate members 46, 48, 50 in providing additional stability to the supporting device 44 without hindering the ability of the plate members 46, 48, 50 to return to their normal, horizontal orientations.

The overlapping/interleaving construction of the supporting device 44 also inhibits the ball-striking area 40 (i.e., the plate member 46 and/or the plate member 48) from sagging without compromising its flexibility and resilience. With reference to FIG. 6, the distal free ends 60, 54 of the plate members 46, 48, respectively, are successively supported by portions of the underlying plate members 48, 50, respectively, (referred to hereinafter as "the proximal portions") which are proximate to the fastening points (i.e., the mounting ends 52, 58) of the plate members 48, 50, respectively. As a result, the farthest and therefore highly flexible edges of the plate members 46, 48 (i.e., the distal free ends 60, 54, respectively) rest on, and are hence supported by, the proximal and hence less flexible portions of the underlying plate members 48, 50, respectively. In such circumstances, even if a long plate member is utilized in the supporting device 44, it would be inhibited from sagging and would hence be maintained substantially planar throughout its entire length, including its mid-portion, under normal condition (i.e., when it is not struck by a golf club) without significantly reducing its flexibility and resilience. In this manner, the overlapping/interleaving plate members 46, 48, 50 cooperate to form a highly resilient, simple supporting system without requiring a large number of parts or components.

It should be noted that the present invention can have numerous modifications and variations. For instance, one of the plate members 46, 48, 50 can be eliminated (i.e., the platform 10 can be provided with only two plate members that are at least partially overlapped with one another). Alternatively, the supporting device 44 can be provided with more than three plate members. Because each of the plate members 46, 48, 50 is relatively thin, they can accommodate additional plate members without significantly increasing the overall thickness of the supporting device 44. The plate members 46, 48, 50 can also be attached to the stand 12 via removable mechanisms (e.g., screws) such that they can be independently and selectively removed from the stand 12 and/or replaced with replacement plate members. Further, the plate members 46, 48, 50 can be of any suitable shape and/or size.

The platform 10 can also be modified such that the ball-striking area 40 is a separate and independent unit from the rest of the stand 12 (e.g., the rest of the stand 12 can be eliminated, leaving only the ball-striking area 44 and the supporting device 40 as an integrated unit such that the resulting golf practice device can be utilized by a user standing on the ground). In such circumstances, the platform 10 can be easily disassembled or dismantled so as to allow same to be transported or stored conveniently in two or more pieces. In addition, the platform 10 can be provided with another ball-striking area located opposite the ball-striking area 40 such that both left-handed and right-handed users can easily practice golf swings without turning or rotating the platform 10.

The platform 10 can be provided with one or more rubber/plastic ball-holders or tees positioned, for example, along one or more of the lateral sides 14, 16 and the transverse side 20, for allowing users to practice tee shots. Moreover, the ball-striking area 40 can be provided with a ball-holder or a tee such that tee shots can be made by a user without turning or rotating the platform 10. Similarly, additional layers can be placed over the ball-striking area 40 (i.e., over the cutout 28) for simulating a different type of golf shot. For instance, a substantially shaggy mat can be placed on the ball-striking area 40 for simulating the sensation of a shot from a sand trap or the rough.

The upper layer 36 can be permanently or removably affixed to the lower layer 42 and/or the stand 12, thereby inhibiting the upper layer 36 from moving relative to the stand 12 and hence enhancing traction between the user and the platform 10. Alternatively, because the lower layer 42 provides the necessary friction between the upper layer 36 and the stand 12, the upper layer 36 can be loosely placed on the stand 12 without being affixed thereto or to the lower layer 42. In this manner, when the portion 38 of the upper layer 36 covering the cutout 28 becomes worn, the loosely mounted upper layer 36 can be rotated or re-orientated easily so that the cutout 28 is covered by another portion of the upper layer 36. The loosely mounted upper layer 36 is also adapted for easy replacement.

It will be understood that the embodiment described herein is merely exemplary and that a person skilled in the art may make many variations and modifications without departing from the spirit and scope of the invention. All such variations and modifications, including those discussed above, are intended to be included within the scope of the invention as defined in the appended claims.

I claim:

1. A practice device allowing users to practice golf swings, comprising a body including an opening; a ball-supporting surface formed generally over said opening for supporting a golf ball thereon; and a supporting device spanning said opening for supporting said ball-supporting surface, said supporting device including a plurality of plate members extending from said body into said opening and at least partially overlapping with each other such that at least a portion of said ball-supporting surface is movable in a generally downward direction when said ball-supporting surface is struck by a golf club.

2. The practice device of claim 1, wherein said plurality of plate members includes first and second plate members overlapped with one another.

3. The practice device of claim 2, wherein each of said first and second plate members is cantilevered from said body such that it is deflectable in said downward direction when said ball-supporting surface is struck by a golf club.

4. The practice device of claim 3, wherein said first and second plate members include first and second free ends, respectively, each of which is located in said opening, said first end of said first plate member being movably supported on said second plate member.

5. The practice device of claim 4, wherein said body includes first and second edges spaced from one another and at least partially defining said opening of said body, said first plate member extending from said first edge generally toward said second edge, and said second plate member extending from said second edge generally toward said first edge.

6. The practice device of claim 5, wherein said first plate member terminates at said first free end, which is spaced from said second edge of said body, said second plate member terminating at said second free end, which is spaced from said first edge of said body.

7. The device of claim 6, wherein said plurality of plate members includes a third plate member extending from said body into said opening and overlapping with said first and second plate members, said second plate member being interleaved between said first and third plate members.

8. The practice device of claim 7, wherein said third plate member is cantilevered from said body such that it is deflectable in said downward direction when said ball-supporting surface is struck by a golf club.

9. The practice device of claim 8, wherein said third plate member has a third free end located in said opening, said second end of said second plate member being movably supported on said third plate member.

10. The practice device of claim 9, wherein said third plate member extends from said first edge of said body generally toward said second edge of said body and terminates at said third end, which is spaced from said second edge of said body.

11. The practice device of claim 10, wherein each of said first, second and third plate members is made from a substantially flexible, resilient material.

12. The device of claim 2, wherein said plurality of plate members includes a third plate member extending from said body into said opening and overlapping with said first and second plate members, said second plate member being interleaved between said first and third plate members.

13. The device of claim 12, wherein said first plate member is movably supported on said second plate member, said second plate member being movably supported on said third plate member, each of said first, second and third plate members being made from a flexible, resilient material.

14. The practice device of claim 1, wherein said body includes a flexible cover layer overlying said supporting device so as to define said ball-supporting surface of said body.

15. The practice device of claim 14, wherein said body includes a supporting surface for supporting a golfer thereon, said cover layer being sized and shaped so as to cover said supporting surface of said body.

16. A practice device allowing users to practice golf swings, comprising a body including an opening; a ball-supporting surface formed generally over said opening for supporting a golf ball thereon; and a supporting device spanning said opening for supporting said ball-supporting surface, said supporting device including first and second plate members, each of which is cantilevered from said body, said first and second plate members being flexible and at least partially overlapping with each other such that at least a portion of said ball-supporting surface is deflectable in a generally downward direction when said ball-supporting surface is struck by a golf club.

17. The practice device of claim 16, wherein said supporting device includes a third plate member at least partially overlapped with said first and second plate members.

18. The practice device of claim 17, wherein said second plate member is interleaved between said first and third plate members.

19. The practice device of claim 18, wherein each of said first, second and third plate members extends from said body into said opening.

20. The practice device of claim 19, wherein said opening includes a pair of generally opposing sides, said first and third plate members extending from one of said sides of said opening towards the other one of said sides of said opening, said second plate member extending from said other one of said sides of said opening toward said one of said sides of said opening.

* * * * *